US009984791B2

(12) United States Patent
Rybski et al.

(10) Patent No.: US 9,984,791 B2
(45) Date of Patent: May 29, 2018

(54) ELECTRICAL CONDUCTOR FOR AERONAUTICAL APPLICATIONS

(71) Applicant: NEXANS, Paris (FR)

(72) Inventors: Patrick Rybski, Yerres (FR); Sébastien Dablement, Oisy (FR); Werner Wilcken, Bramsche (DE)

(73) Assignee: NEXANS, Paris (FR)

( * ) Notice: Subject to any disclaimer, the term of this patent is extended or adjusted under 35 U.S.C. 154(b) by 0 days. days.

(21) Appl. No.: 15/373,839

(22) Filed: Dec. 9, 2016

(65) Prior Publication Data

US 2017/0169915 A1 Jun. 15, 2017

(30) Foreign Application Priority Data

Dec. 9, 2015 (FR) ..... 15 62065

(51) Int. Cl.
*H01B 5/08* (2006.01)
*H01B 1/02* (2006.01)
*H01B 7/00* (2006.01)

(52) U.S. Cl.
CPC ..... *H01B 5/08* (2013.01); *H01B 1/023* (2013.01); *H01B 1/026* (2013.01); *H01B 7/0009* (2013.01)

(58) Field of Classification Search
CPC ..... H01B 5/08; H01B 1/023; H01B 1/026
USPC ..... 174/126.2
See application file for complete search history.

(56) References Cited

U.S. PATENT DOCUMENTS 4,275,262 A * 6/1981 Sellars ..... H01B 7/14 174/107
2004/0060726 A1* 4/2004 Orlet ..... H01B 7/046 174/120 R
2007/0251204 A1* 11/2007 Susai ..... H01B 13/0006 57/9
2013/0284488 A1* 10/2013 Yabuki ..... H01B 7/0009 174/110 R

FOREIGN PATENT DOCUMENTS

| | | |
|---|---|---|
| DE | 29802010 | 4/1999 |
| EP | 2657944 | 10/2013 |
| FR | 3009126 | 1/2015 |
| JP | 2010129257 | 6/2010 |
| JP | 2014175137 | 9/2014 |

OTHER PUBLICATIONS

Search Report dated Jul. 26, 2016.
Search Report dated Mar. 30, 2017.

* cited by examiner

*Primary Examiner* — Timothy Thompson
*Assistant Examiner* — Charles Pizzuto
(74) *Attorney, Agent, or Firm* — Sofer & Haroun, LLP

(57) ABSTRACT

A stranded electrical conductor includes a single center strand in aluminum or aluminum alloy (10, 20, 30, 40A, 50A) and a plurality of conductor strands (11, 21, 31, 41, 51) arranged in at least one layer around said center strand. The relation between the diameter of said center strand in aluminum or aluminum alloy and the diameter of said peripheral conductor strands is greater than or equal to 3.

6 Claims, 3 Drawing Sheets

ELECTRICAL CONDUCTOR FOR AERONAUTICAL APPLICATIONS

RELATED APPLICATION

This application claims the benefit of priority from French Patent Application No. 15 62065, filed on Dec. 9, 2015, the entirety of which is incorporated by reference.

BACKGROUND

Field of the Invention

The invention relates to an electrical conductor for aeronautical applications.

Description of the Related Art

Patent document FR 3 009 126 describes such a stranded electrical conductor comprising at least one center strand in silver-plated aluminum and a plurality of silver-plated copper strands arranged around said center strand.

More precisely, said document describes a first conductor comprising one aluminum strand arranged in the center of the conductor, surrounded by six peripheral copper strands in contact two-by-two and arranged in a single layer.

It also describes a second conductor comprising seven aluminum strands arranged in the center of the conductor, namely one center strand surrounded by six strands, said seven strands being surrounded by twelve peripheral copper strands in contact two-by-two and arranged in a single layer.

It finally describes a third conductor comprising nineteen aluminum strands arranged in the center of the conductor, namely one center strand surrounded by six strands, surrounded by twelve strands, said nineteen strands being surrounded by eighteen peripheral copper strands in contact two-by-two and arranged in a single layer.

According to all the described embodiments, the diameter of the center aluminum strands is substantially equal to that of the peripheral copper strands.

Assembly cohesion of the strands is obtained by means of an assembly operation, commonly known as stranding, and which makes it possible, by twisting and according to a preferred pitch value, to maintain the relative position of each strand in relation to the others.

The aluminum strands are therefore of a smaller diameter and their assembly by stranding is difficult on account of the fragility of said strands.

Furthermore, a stranded electrical conductor is known from Patent document WO 2012/073843, comprising a single center strand possibly in aluminum or aluminum alloy and a plurality of conductor strands arranged in at least one layer around said center strand.

OBJECTS AND SUMMARY

Without compromising the flexibility of the conductor, the invention proposes to reduce the use of aluminum strands with such a small cross section.

To do this, the invention proposes a stranded electrical conductor comprising a single center strand in aluminum or aluminum alloy and a plurality of conductor strands arranged in at least one layer around said center strand, wherein the relation between the diameter of said center strand in aluminum or aluminum alloy and the diameter of the peripheral conductor strands is greater than or equal to 3.

According to a preferred embodiment, the relation between the diameter of said center strand in aluminum or aluminum alloy and the diameter of the peripheral conductor strands is between 3 and 5.

The diameter of all said peripheral conductor strands is preferably substantially identical.

Furthermore, the size known as American Wire Gauge (acronym AWG, also known by the name Brown and Sharp (B&S) Wire Gauge) is a unit of measurement used in the United States among others, allowing the diameter of a single-strand non-ferrous metal conductor to be measured and standardized. Said size is defined by the following data:

| AWG | Diameter (mm) | Cross-section ($mm^2$) |
|---|---|---|
| 12 | 2.05 | 3.31 |
| 13 | 1.83 | 2.62 |
| 14 | 1.63 | 2.08 |
| 15 | 1.45 | 1.65 |
| 16 | 1.29 | 1.31 |
| 17 | 1.15 | 1.04 |
| 18 | 1.02 | 0.823 |
| 19 | 0.912 | 0.653 |
| 20 | 0.812 | 0.518 |
| 21 | 0.723 | 0.410 |
| 22 | 0.644 | 0.326 |
| 23 | 0.573 | 0.258 |
| 24 | 0.511 | 0.205 |
| 25 | 0.455 | 0.162 |
| 26 | 0.405 | 0.129 |
| 27 | 0.361 | 0.102 |
| 28 | 0.321 | 0.0810 |
| 29 | 0.286 | 0.0642 |
| 30 | 0.255 | 0.0509 |

Said size is also used to describe conductors with several stranded wires. In this case, it refers to a conductor whose transverse cross section is equal to the sum of the transverse cross sections of the individual wires, the space between individual wires not being considered.

According to an embodiment of the invention, the conductor being AWG between 16 and 30, comprising a single center strand in aluminum or aluminum alloy and a plurality of conductor strands arranged around said center strand, the relation between the diameter of said strand in aluminum or aluminum alloy and the diameter of said peripheral conductor strands is 3, said peripheral conductor strands being in contact two-by-two and twelve in number.

Advantageously, said conductor strands are in copper or copper alloy. They can also be hybrid, comprising, for example, an aluminum part and a copper part.

At least one of said conductor strands preferably consists of at least one layer of copper and one layer of silver-plated copper alloy, whose mass ratio of silver is between 0.1% and 0.5%.

The mass ratio represents the relation between the mass of silver and the mass of silver-plated copper alloy. The specific contribution of each strand consisting of a layer in copper and a layer of silver-plated copper alloy, whose mass ratio of silver is between 0.1% and 0.5%, is that it allows the conductor to have greater mechanical strength than that of a copper strand of an equivalent cross-section, without degrading electric conductivity. The conductor can possess either a single strand or several strands of such a composition. Said conductor can also comprise other conductor strands consisting of different compositions.

Strands arranged on the periphery of the conductor and consisting of at least one layer of copper and one layer of silver-plated copper alloy make it possible to minimize contact resistances consecutive to the connection of connection components by the user.

The strands are advantageously coated with a protective layer vis-à-vis corrosion.

Mechanical strains, variations of temperature, hygrometry and pressure, together with insulating materials, in effect impose on conductors and hence on the constituent strands of said conductors, a specific adaptation vis-à-vis the risks of corrosion.

The protective layer can be a layer of nickel.

The invention also relates to an electric cable consisting of at least such a conductor.

BRIEF DESCRIPTION OF THE DRAWINGS

The invention is described below in more detail with the help of the figures, showing only preferred embodiments of the invention.

DETAILED DESCRIPTION

Figure 1:
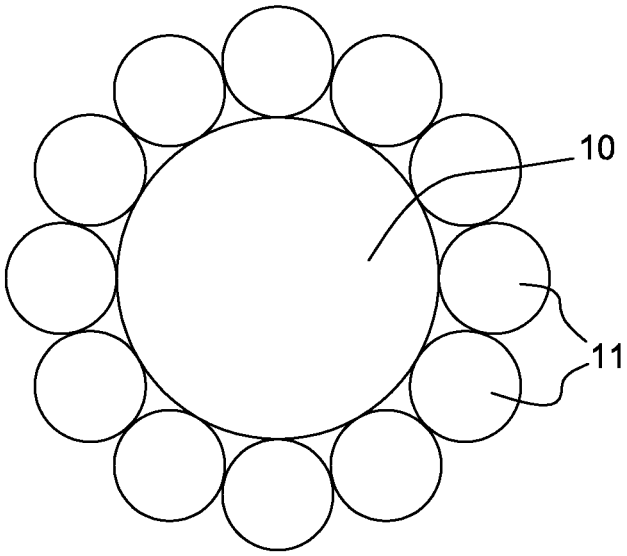
FIG. 1 is a view in transverse section of a first embodiment of the invention.

The conductor shown on FIG. 1 is AWG between 16 and 30 and comprises a single center strand 10 in aluminum or aluminum alloy and a plurality of strands 11 in copper or copper alloy arranged around said center strand. The relation between the diameter of the strand in aluminum or aluminum alloy and the diameter of the peripheral strands in copper or copper alloy is 3, said peripheral strands in copper or copper alloy being in contact two-by-two and twelve in number. The relation between the cross section of the strand in aluminum or aluminum alloy and the cross section of the peripheral strands in copper or copper alloy is 43%.

More precisely, the characteristics of the strands according to AWG are specified in table 1 below.

TABLE 1

| | Al/Al alloy strands | | | Cu/Cu alloy strands | | |
|---|---|---|---|---|---|---|
| AWG | Number | Wire Ø mm | Cross section $mm^2$ | Number | Wire Ø mm | Cross section $mm^2$ |
| 30 | 1 | 0.191 | 0.029 | 12 | 0.0635 | 0.038 |
| 28 | 1 | 0.236 | 0.044 | 12 | 0.0785 | 0.058 |
| 26 | 1 | 0.3 | 0.071 | 12 | 0.1 | 0.094 |
| 24 | 1 | 0.345 | 0.093 | 12 | 0.115 | 0.125 |
| 22 | 1 | 0.48 | 0.181 | 12 | 0.16 | 0.241 |
| 20 | 1 | 0.609 | 0.291 | 12 | 0.203 | 0.388 |
| 18 | 1 | 0.762 | 0.456 | 12 | 0.254 | 0.608 |
| 16 | 1 | 0.9 | 0.636 | 12 | 0.3 | 0.848 |

Figure 2:
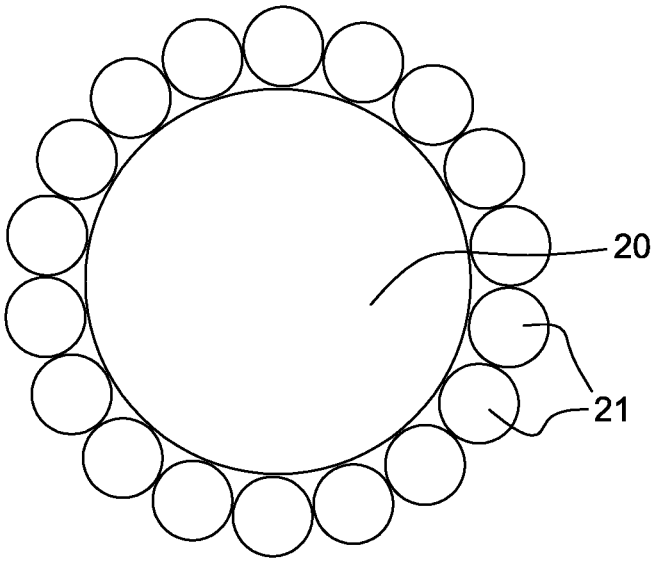
FIG. 2 is a view in transverse section of a second embodiment of the invention.

The conductor shown on FIG. 2 is AWG 12 or 14 and comprises a single center strand 20 in aluminum or aluminum alloy and a plurality of strands 21 in copper or copper alloy arranged around said center strand. The relation between the diameter of the strand in aluminum or aluminum alloy and the diameter of the peripheral strands in copper or copper alloy is 5, said peripheral strands in copper or copper alloy being in contact two-by-two and eighteen in number. The relation between the cross section of the strand in aluminum or aluminum alloy and the cross section of the peripheral strands in copper or copper alloy is 58%.

More precisely, the characteristics of the strands according to AWG are specified in table 2 below.

TABLE 2

| | Al/Al alloy strands | | | Cu/Cu alloy strands | | |
|---|---|---|---|---|---|---|
| AWG | Number | Wire Ø mm | Cross section $mm^2$ | Number | Wire Ø mm | Cross section $mm^2$ |
| 14 | 1 | 1.250 | 1.227 | 18 | 0.25 | 0.884 |
| 12 | 1 | 1.600 | 2.011 | 18 | 0.32 | 1.448 |

Figure 3:
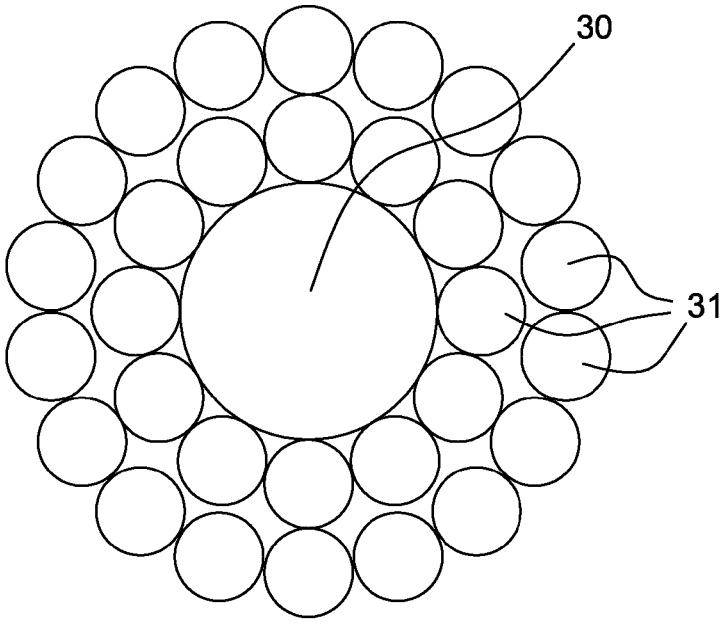
FIG. 3 is a view in transverse section of a third embodiment of the invention.

The conductor shown on FIG. 3 is AWG 12 or 14 and comprises a single center strand 30 in aluminum or aluminum alloy and a plurality of strands 31 in copper or copper alloy arranged around said center strand. The relation between the diameter of the strand in aluminum or aluminum alloy and the diameter of the peripheral strands in copper or copper alloy is 3, said peripheral strands in copper or copper alloy being in contact two-by-two and arranged in two layers of twelve and eighteen strands. The relation between the cross section of the strand in aluminum or aluminum alloy and the cross section of the peripheral strands in copper or copper alloy is 23%.

More precisely, the characteristics of the strands according to AWG are specified in table 3 below.

TABLE 3

| | Al/Al alloy strands | | |
|---|---|---|---|
| AWG | Number | Wire Ø mm | Cross section $mm^2$ |
| 14 | 1 | 0.750 | 0.442 |
| 12 | 1 | 0.960 | 0.724 |

| | Cu/Cu alloy strands | | | | | |
|---|---|---|---|---|---|---|
| AWG | Number Layer 1 | Wire Ø mm | Cross section $mm^2$ | Number Layer 2 | Wire Ø mm | Cross section $mm^2$ |
| 14 | 12 | 0.250 | 0.589 | 18 | 0.25 | 0.884 |
| 12 | 12 | 0.320 | 0.965 | 18 | 0.32 | 1.448 |

Figure 4:
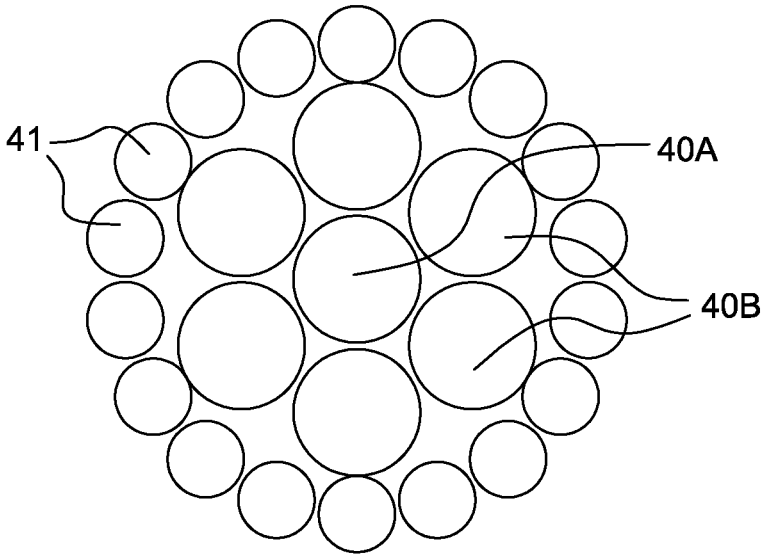
FIG. 4 is a view in transverse section of a fourth embodiment of the invention.

The conductor shown on FIG. 4 is AWG 12 or 14 and comprises a layer of six strands 40B in aluminum on a center strand 40A and a plurality of strands 41 in copper or copper alloy arranged in a single layer around said center strands. The relation between the diameter of the strands in aluminum or aluminum alloy and the diameter of the peripheral strands in copper or copper alloy is 1.67, said peripheral strands in copper or copper alloy being in contact two-by-two and eighteen in number. The relation between the cross section of the strands in aluminum or aluminum alloy and the cross section of the peripheral strands in copper or copper alloy is 52%.

More precisely, the characteristics of the strands according to AWG are specified in table 4 below.

TABLE 4

| | Al/Al alloy strands | | | | | |
|---|---|---|---|---|---|---|
| AWG | Number Core | Wire Ø mm | Cross section $mm^2$ | Number Layer 1 | Wire Ø mm | Cross section $mm^2$ |
| 14 | 1 | 0.417 | 0.136 | 6 | 0.417 | 0.818 |
| 12 | 1 | 0.533 | 0.223 | 6 | 0.533 | 1.340 |

| | Cu/Cu alloy strands | | |
|---|---|---|---|
| AWG | Number | Wire Ø mm | Cross section $mm^2$ |
| 14 | 18 | 0.25 | 0.884 |
| 12 | 18 | 0.32 | 1.448 |

Figure 5:
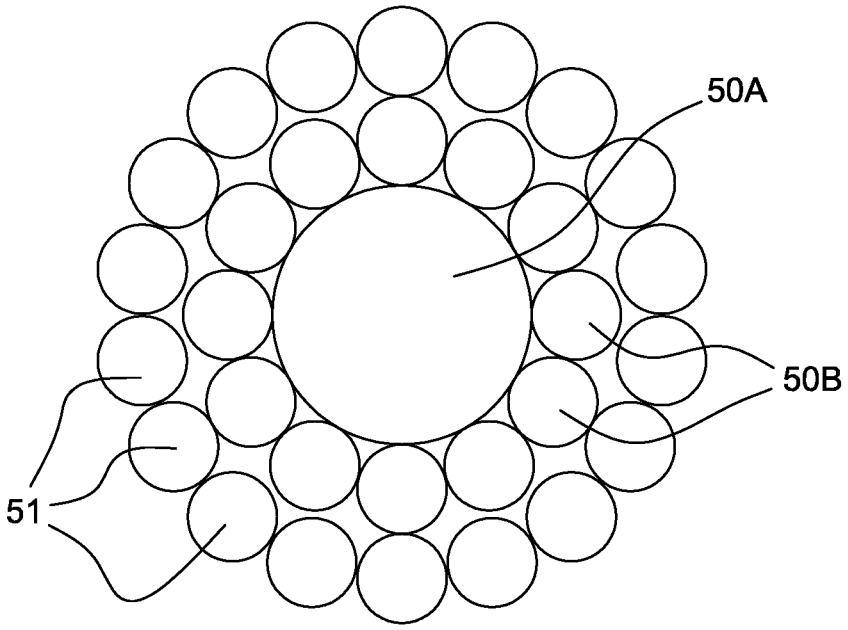
FIG. 5 is a view in transverse section of a fifth embodiment of the invention.

The conductor shown on FIG. 5 is AWG 12 or 14 and comprises a layer of twelve strands 50B in aluminum on the center strand 50A and a plurality of strands 51 in copper or copper alloy arranged in a single layer around said center strands. The relation between the diameter of the center strand 50A in aluminum or aluminum alloy and the diameter of the peripheral strands in copper or copper alloy is 3, said peripheral strands in copper or copper alloy being in contact two-by-two and eighteen in number.

The relation between the cross section of the strands in aluminum or aluminum alloy 50A and 50B in aluminum or aluminum alloy and the cross section of the peripheral strands in copper or copper alloy is 54%. As for the relation between diameter of the center strand 50A in aluminum or aluminum alloy and the diameter of the layer of strands in aluminum or aluminum alloy surrounding it, it is also 3.

More precisely, the characteristics of the strands according to AWG are specified in table 5 below.

TABLE 5

| | Al/Al alloy strands | | | | | |
|---|---|---|---|---|---|---|
| AWG | Number Core | Wire Ø mm | Cross section $mm^2$ | Number Layer 1 | Wire Ø mm | Cross section $mm^2$ |
| 14 | 1 | 0.750 | 0.442 | 12 | 0.250 | 0.589 |
| 12 | 1 | 0.960 | 0.724 | 12 | 0.320 | 0.965 |

| | Cu/Cu alloy strands | | |
|---|---|---|---|
| AWG | Number | Wire Ø mm | Cross section $mm^2$ |
| 14 | 18 | 0.25 | 0.884 |
| 12 | 18 | 0.32 | 1.448 |

In every case, the conductor strands are arranged together such that the circular cross section of the conductor is as circular as possible. In effect, such a conductor is easy to handle. Furthermore, its flexing behavior is identical, whatever the direction of flexion. It is therefore easier to deploy and connect in order to make an electrical connection between different devices.

The invention claimed is:

1. A stranded electrical conductor being AWG between 16 and 30, comprising:

a single center strand in aluminum or aluminum alloy and the plurality of conductor strands arranged around a center strand, the diameter of all said peripheral conductor strands is substantially identical, wherein the relation between the diameter of said strand in aluminum or aluminum alloy and the diameter of said peripheral conductor strands is 3, said peripheral conductor strands being in contact two-by-two and twelve in number.

2. The conductor as claimed in claim 1, wherein said peripheral conductor strands are in copper or copper alloy.

3. The conductor as claimed in claim 1, wherein at least one of said peripheral conductor strands consists of at least one layer of copper and one layer of silver-plated copper alloy, whose mass ratio of silver is between 0.1% and 0.5%.

4. The electrical conductor as claimed in claim 1, wherein said strands are coated with a protective layer vis-à-vis corrosion.

5. The electrical conductor as claimed in claim 4, wherein said protective layer is a layer of nickel.

6. An electric cable comprising at least one conductor as claimed in claim 1.

* * * * *